US006986627B2

(12) United States Patent
Feld

(10) Patent No.: US 6,986,627 B2
(45) Date of Patent: Jan. 17, 2006

(54) CYLINDRICAL BORE HEAD TOOL WITH HARD METAL CUTTERS

(75) Inventor: Harald Feld, Ehingen (DE)

(73) Assignee: Tigra Harlstoff GmbH, Oberndorf (DE)

( * ) Notice: Subject to any disclaimer, the term of this patent is extended or adjusted under 35 U.S.C. 154(b) by 267 days.

(21) Appl. No.: 10/320,357

(22) Filed: Dec. 13, 2002

(65) Prior Publication Data

US 2003/0118415 A1 Jun. 26, 2003

(30) Foreign Application Priority Data

Dec. 15, 2001 (DE) ..... 101 61 823

(51) Int. Cl.
*B23B 51/02* (2006.01)

(52) U.S. Cl. ..... 408/144; 408/226; 408/231; 408/713

(58) Field of Classification Search ..... 408/144, 408/226, 227, 229, 231, 232, 233, 713, 224, 408/225

See application file for complete search history.

(56) References Cited

U.S. PATENT DOCUMENTS 1,515,548 A * 11/1924 Cerotsky ..... 408/229
2,259,611 A * 10/1941 Burger ..... 408/230
4,160,616 A * 7/1979 Winblad ..... 408/144
4,580,934 A * 4/1986 McCormick ..... 408/201
4,704,055 A * 11/1987 Guhring ..... 408/59
4,762,445 A * 8/1988 Bunting et al. ..... 408/144
5,399,051 A * 3/1995 Aken et al. ..... 408/233
5,957,631 A * 9/1999 Hecht ..... 408/144
6,012,881 A * 1/2000 Scheer ..... 408/227
6,109,841 A * 8/2000 Johne ..... 408/144
6,394,714 B2 * 5/2002 Eberhard ..... 408/211
6,499,919 B2 * 12/2002 Feld ..... 408/213

FOREIGN PATENT DOCUMENTS

| | | |
|---|---|---|
| DE | G 92 06 657.7 | 10/1993 |
| DE | 196 05 157 | 9/1996 |
| DE | 201 02 914 | 6/2001 |
| DE | 100 09 721 | 9/2001 |

* cited by examiner

*Primary Examiner*—Daniel W. Howell
(74) *Attorney, Agent, or Firm*—Klaus T. Bach

(57) ABSTRACT

In a cylindrical cutter head tool including a shaft part with a head support platform and a cutter head disposed on the cutter head support platform, the cutter head support platform and the shaft are an integral part made of tool steel and the cutter head is a sintered hard metal body, and the cutter head support platform and the cutter head include cooperating form-locking elements by which the cutter head is centered on the cutter head support platform and rotationally firmly engaged therewith.

3 Claims, 1 Drawing Sheet

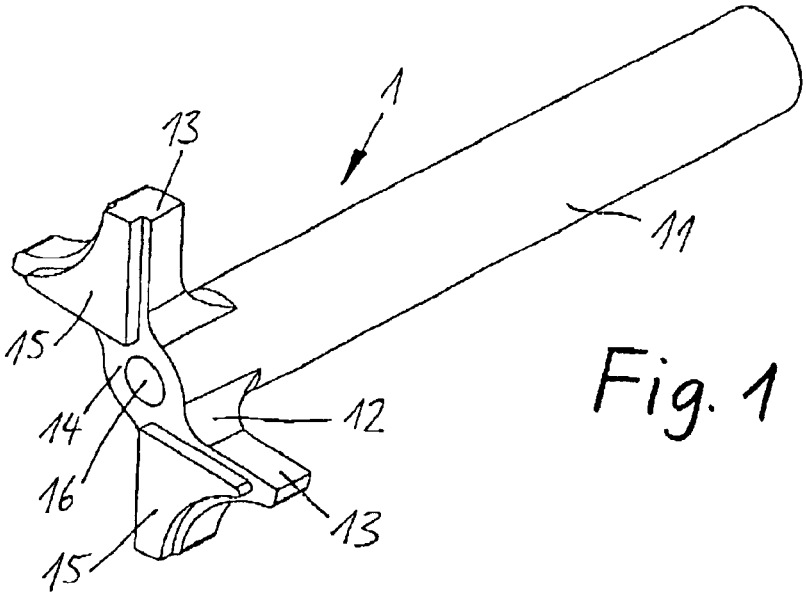
Fig. 1
Fig. 2
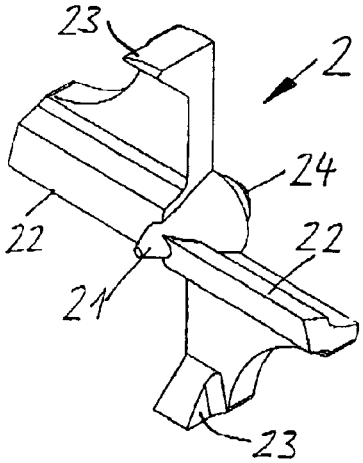
Fig. 3
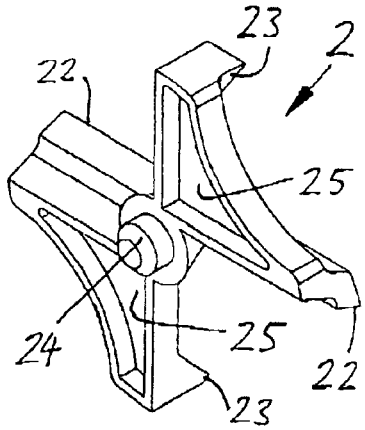

CYLINDRICAL BORE HEAD TOOL WITH HARD METAL CUTTERS

BACKGROUND OF THE INVENTION

The invention relates to a cylindrical bore head tool with hard metal cutters. Hard metal cutters are desirable for cylindrical bore head tools or even necessary since bores, for example in the manufacture of furniture components, are cut into resin-bonded pressed particle boards so that tools of tool steels without hard metal cutters have only an unsatisfactory service life.

The manufacture of a cylindrical bore head with hard metal cutting edges however is complicated and expensive since it requires a bore tip as well as cutting edges extending over the front surface of the tool and also circumferential cutting edges in order to make clean, cylindrical bores.

It is the object of the present invention to provide a cylindrical bore head or a similar tool with hard metal cutting edges in such a way that it can be manufactured in large numbers at relatively low costs, but with high precision.

SUMMARY OF THE INVENTION

In a cylindrical cutter head tool including a shaft part with a cutter head support structure and a cutter head disposed on the cutter head support structure, the cutter head support structure with the shaft are an integral part made of tool steel and the cutter head is a sintered hard metal body, and the cutter head support structure and the cutter head include cooperating plate-like form-locking elements by which the cutter head is centered on the cutter head support structure and rotationally firmly engaged therewith.

The whole cylindrical cutter head, that is, the whole tool head consists of a hard metal which is formed by injection molding using a hard metal powder provided with a wax as plasticizer. The unfinished molded head is then sintered. The shaft with the cutter head support structure is made from a tool steel.

The hard metal cutter head and the head support structure are provided with cooperating form-locking elements by which the head is centered on the shaft when the head is mounted to the shaft and engages the shaft in a rotationally form-fitting relationship in such a way that the head has the proper rotational position with respect to the shaft and the head is rotationally locked to the shaft. The head and the shaft may then be interconnected by soldering or welding in a simple manner.

An embodiment of the invention will be described below in detail on the basis of the accompanying drawings.

BRIEF DESCRIPTION OF THE DRAWINGS

FIG. 1 shows a tool shaft with a head support structure in a perspective view, FIG. 2 is a perspective view of a head as seen from the front end of the tool, and FIG. 3 is a perspective view of the head as seen from the back side thereof.

DESCRIPTION OF A PREFERRED EMBODIMENT

The cylindrical bore head or cutter head tool according to the invention comprises a shaft 1 and a head 2 disposed on the shaft 1.

As shown in FIG. 1, the shaft 1 comprises a shaft part 11 and a bore head support structure 12 disposed at the front end of the shaft part 11. The bore head support structure 12 comprises two radial arms 13 in the form of sections of a disc. The bore head support structure is provided at its front face 14 with two axial surface projections 15, one being provided on each of the radial arms 13, and, furthermore, a central opening 16. The shaft part 11 is cylindrical and serves for mounting the tool in a chuck.

The shaft part consists of tool steel.

FIGS. 2 and 3 show the head 2, which is formed from hard metal as a single piece by injection molding from a hard metal powder mixed with a wax serving as a plasticizer and a bonding compound, and sintering of the unfinished molded piece. During sintering, the wax is completely removed.

The bore or cutting head 2 is provided at its front end with a bore head centering tip 21 and has two main cutting edges 22 extending radially in opposite directions and two precutters 23, which are circumferentially displaced with respect to the cutting edges 22 by 90° and which provide for a circumferential precut of the bore to be cut. Such a cutter configuration is basically conventional.

At its rear side (FIG. 3), the cutting head has a central lug 24, which fits into the central opening 16 of the shaft 1. Furthermore, the head 2 is provided at its rear side with flat recesses 25 formed in the diametrically opposed radial disc sections at the front of which the cutting edges 22, 23 are provided. The flat recesses 25 are exactly complementary to the axial surface projections 15 of the bore head support structure 12 of the shaft part 1.

The bore head 2 can be placed onto the bore head support structure 12 of the shaft 1 whereby the lug 24 at the rear side of the head 2 is snugly received as a centering lug in the opening 16 of the shaft and the surface projections 15 on the bore head support structure 12 of the shaft 1 are received in the flat recesses 25 at the rear side of the head. With this engagement, the head 2 is positioned with respect to the shaft in an exactly centered and rotational position correct manner and in such a way that it can be welded or soldered to the shaft in a simple manner without the need for providing particular holding or support devices for ensuring the accurate position of the parts to be joined during the welding or soldering procedure. Furthermore, the form-locking engagement ensures that operating torques are transmitted from the shaft to the cutting head by the form-fitting engagement and not by the solder or weld connection.

Obviously, the configuration of the bore head support structure 12 of the shaft 1 and of the bore head 2 can be different from the configuration as shown and also the form of the cooperating form-locking structure may be selected so as to be expedient for a particular application.

The shown arrangement for the interconnection of a cylindrical bore head with a shaft may also be used for other cutting tools which include a bore or cutting head supported on a shaft part for mounting in a chuck.

What is claimed is:

1. A cylindrical cutter head tool including a shaft part for mounting the tool in a chuck and having a cutter head support structure disposed at a front end thereof, and a cutter head disposed on said cutter head support structure, said cutter head support structure forming a support platform having a diameter larger than that of the shaft and providing for an engagement area disposed in a plane extending normal to the shaft part, said support platform and said cutter head including in said engagement area cooperating form-locking elements by which said cutter head is centered on said cutter head support platform, said cutter head support structure further including plate-like surface projections on one of said support platform and said cutter head and complementary recesses on the other of said support platform and said cutter head snugly receiving the surface projections thereby providing for a rotationally firm engagement of the cutter head with the cutter head support platform, said shaft part consisting of a tool steel and said cutter head being a hard metal sintered body.

2. A cutter head tool according to claim 1, wherein said cooperating form locking elements comprise a centering lug formed centrally on one of said shaft part and said cutter head and a center opening formed on the other for receiving said lug.

3. A cutter head tool according to claim 1, wherein, for said rotationally firm engagement, said surface projections are provided on said shaft part, the complementary recesses are provided on the bore head.

* * * * *